United States Patent [19]

Barber

[11] 4,288,170

[45] Sep. 8, 1981

[54] FILE BINDING SYSTEM

[75] Inventor: Donald T. Barber, Willowdale, Canada

[73] Assignee: Datafile Limited, Willowdale, Canada

[21] Appl. No.: 71,531

[22] Filed: Aug. 31, 1979

[51] Int. Cl.[3] ..... B42F 13/36

[52] U.S. Cl. ..... 402/17; 402/64; 281/15 A

[58] Field of Search ..... 402/15, 17, 60, 64, 402/68, 71, 80 P; 281/15 A, 15 B

[56] References Cited

U.S. PATENT DOCUMENTS

| | | | |
|---|---|---|---|
| 669,778 | 3/1901 | Cordes | 402/64 |
| 1,180,927 | 4/1916 | Jenkins | 402/64 X |
| 3,628,877 | 12/1971 | Barnes | 402/17 |
| 3,957,321 | 5/1976 | Rose | 402/17 X |
| 4,184,782 | 1/1980 | Giule | 402/15 |

*Primary Examiner*—Paul A. Bell
*Assistant Examiner*—John S. Brown

[57] ABSTRACT

A file binding system according to the present invention comprises a pair of elongated rigid support members for supporting a file along its edge and securing members for securing the support members in position. The support members are fully separable from one another and from the file edge with the securing members being independent of the support members other than in the securing position, thereby adapting the arrangement for use with essentially any file size. Furthermore, each of the securing members includes securing portions for securing the support members from their outer sides along the file edge. This latter feature not only facilitates binding adjustment but also provides an extremely effective clamping of the file edge between the support members.

5 Claims, 8 Drawing Figures

FIG. 1
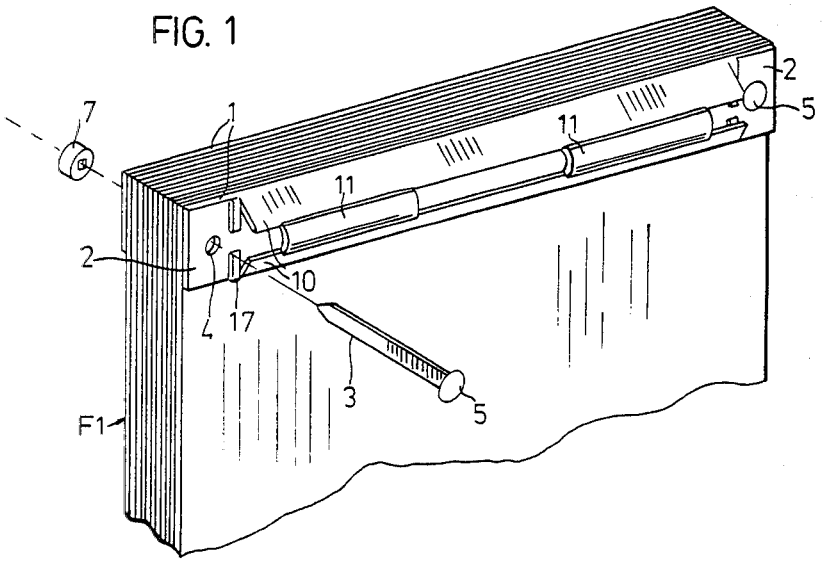
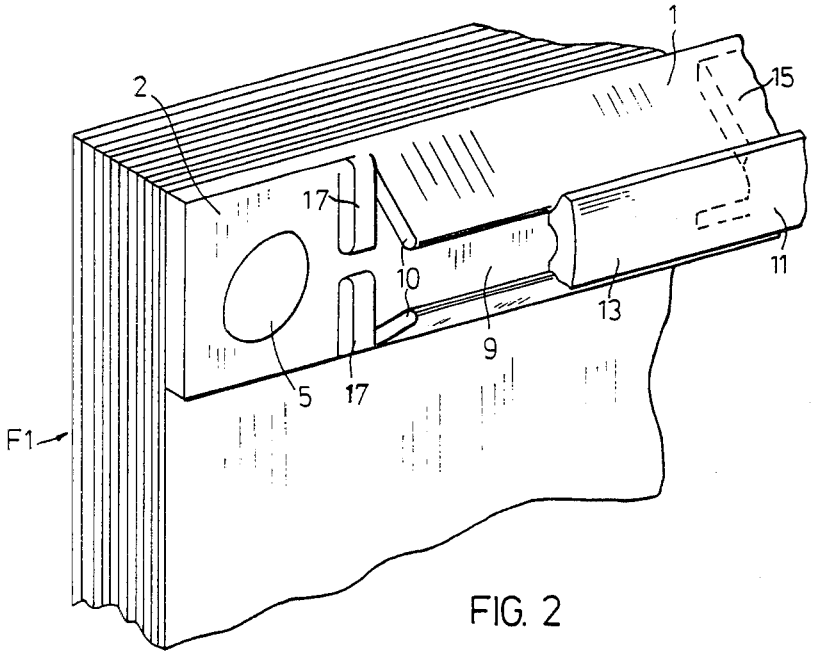
FIG. 2

FIG. 5
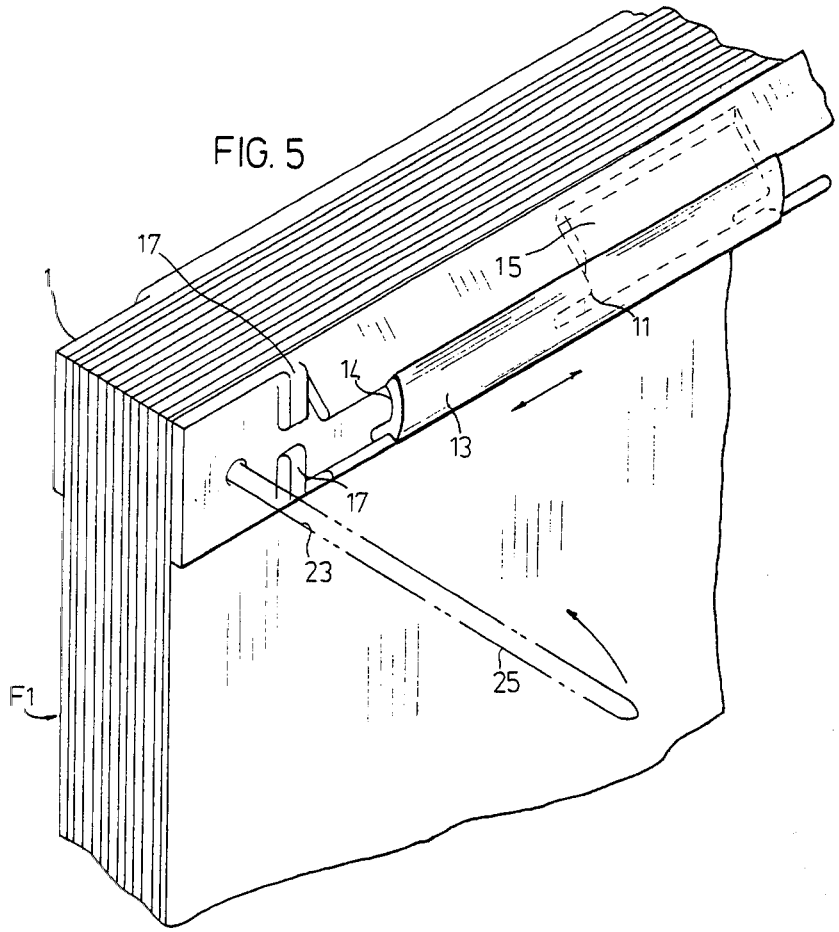
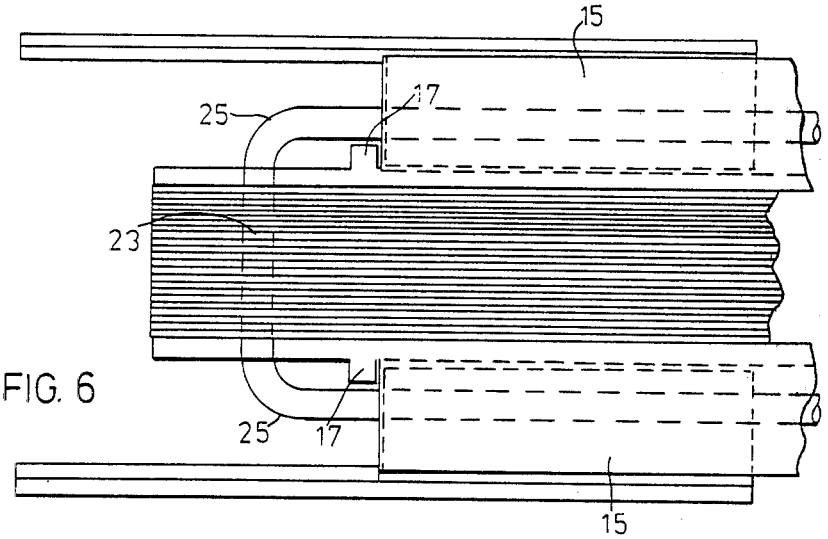
FIG. 6

FIG. 7
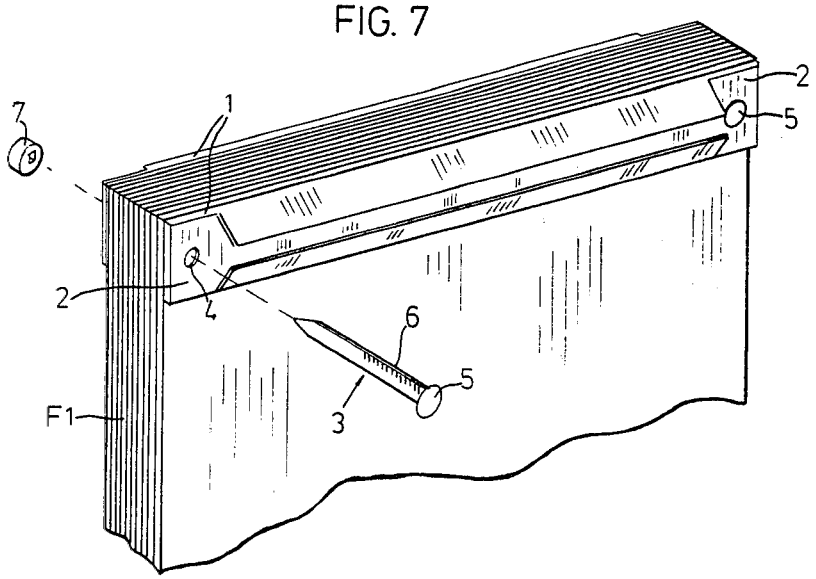
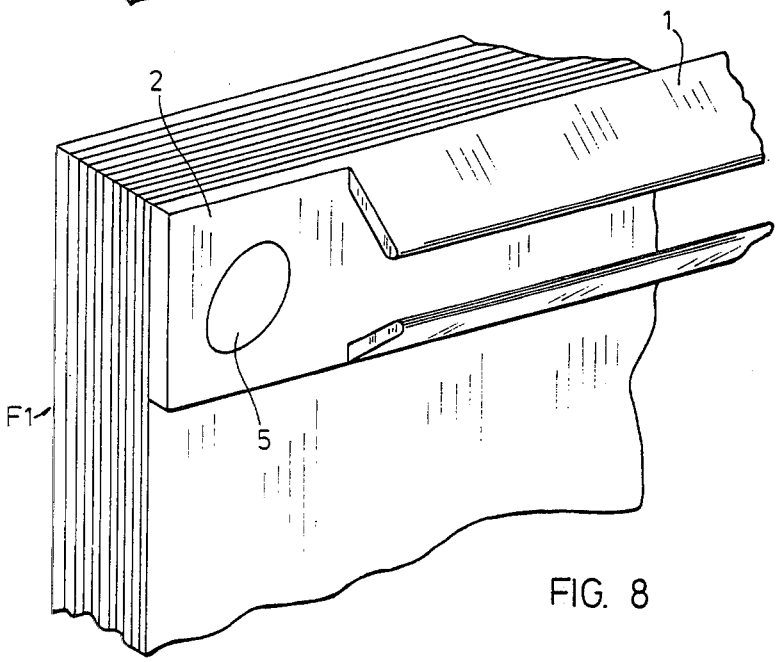
FIG. 8

FILE BINDING SYSTEM

FIELD OF THE INVENTION

The present invention relates to a file binding system in which a pair of rigid support members are adjustably clamped by securing members along a file edge.

BACKGROUND OF THE INVENTION

Conventional file binding arrangements are generally limited to a single capacity due to their fixed structural features. Once that capacity has been reached, a larger replacement binder is required. On the otherhand, if the binder is not filled to capacity then it unnecessarily occupies excess valuable filing space. Typical arrangements of prior art are the ring type binder in which there is no ring size adjustment and the arrangement shown in U.S. Pat. No. 4,000,951 issued Jan. 4, 1977 to Agnew et al. As is clearly shown in the Agnew Patent, once full binding capacity has been reached, the entire arrangement must be replaced with a larger file binder. In addition, there is no way of decreasing the thickness of the Agnew binder so that if it is not completely filled, the binder is wider than the file papers which means that the file takes up more room than is necessary, resulting in a wastage of valuable filing space.

A somewhat different arrangement is shown in U.S. Pat. No. 3,970,331 issued July 20, 1976 to Joe D. Giulie. Giulie although, not initially limited to a single file capacity is permanent once a specific filing capacity has been chosen and the arrangement secured in place, along a file edge. Therefore, Giulie suffers from the drawback that he cannot provide for file size adjustment after initial use of his system. The file binding system of the present invention provides an answer to the drawbacks of the prior art. It comprises a pair of elongated rigid support members for supporting a file along its edge and securing members for securing the support members in position. The support members are fully separable from one another and from the file edge with the securing members being independent of the support members, other than in the securing position, thereby adapting the arrangement for use with essentially any file size.

The securing portions of the securing members are located on the outer sides of the support members, which not only facilitates binding adjustment but in addition, provides an extremely effective clamping of the file edge between the support members. As a result the system occupies only the space required to effectively bind the file.

In order to adjust the capacity of the system, the securing members are quickly and easily released by virtue of their independency from the support members. Moreover, because the support members are fully separable from one another, they are totally reusable on the file, regardless of its adjusted size.

According to a preferred feature of the present invention, the filing system is characterized by the provision of adjustable extension members slidable along the outer sides of the rigid support members with the arrangement being adapted to permit outward adjustment of the extension members outwardly beyond the securing portions to increase the overall length of the file and inward adjustment of the extension members, inwardly of the securing portions to gain access to the securing portions.

BRIEF DISCUSSION OF THE DRAWINGS

The above as well as other features and advantages of the present invention will be described in greater detail according to the following detailed description wherein:

FIG. 1 is a partially exploded perspective view looking down on a file binding system according to a preferred aspect of the present invention; including adjustable extension members;

FIG. 2 is an enlarged assembled perspective view of the arrangement shown in FIG. 1;

FIG. 5 is a perspective view looking down on an alternative preferred file binding arrangement including adjustable extension members according to the present invention;

FIG. 6 is a top view showing an arrangement similar to that shown in FIG. 5 with the securing member in a fully secured position and with the extension members in an extended position;

FIG. 7 is an exploded perspective view of a more basic preferred arrangement of the present invention without adjustable extension members;

FIG. 8 is an enlarged perspective view of one end of the arrangement of FIG. 7 when assembled;

Figure 4:
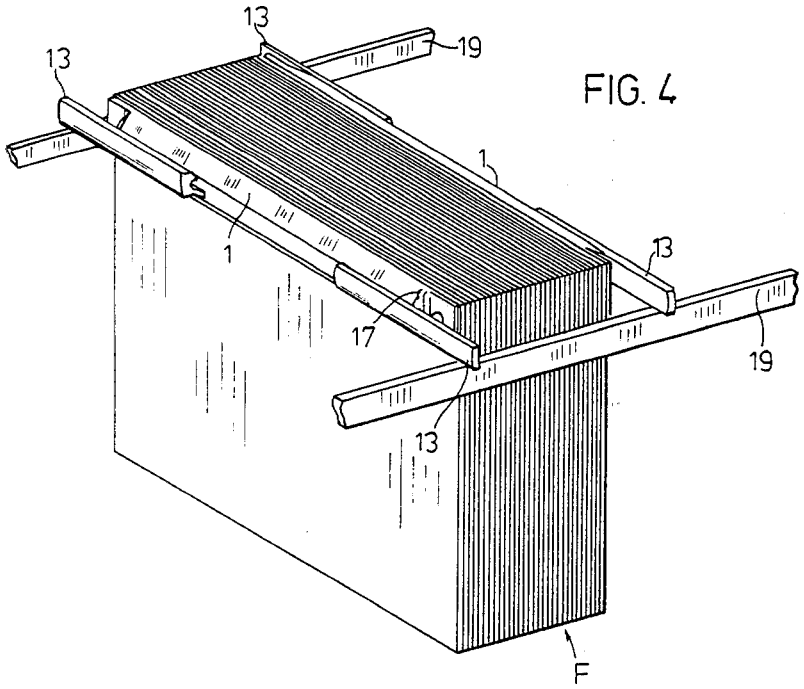
FIG. 4 is a perspective view looking down on a file bound and hung in a file rack by means of the file binding arrangement shown in FIGS. 1 through 3.

DETAILED DESCRIPTION ACCORDING TO THE PREFERRED EMBODIMENTS OF THE PRESENT INVENTION

Referring first to FIGS. 7 and 8, a basic file binding arrangement according to the present invention includes a pair of elongated rigid support members, 1 and securing members 3, used to clamp support members 1, along the edge of a file, generally indicated at F. Members 1 may be made from material such as aluminum or the like, so that they are not only extremely rigid but also very durable and light in weight. The securing members on the otherhand, are preferably made from a relatively pliable material, such as plastic or nylon, which makes them easy to work with and which facilitates binding adjustment.

Each of the rigid support members is provided at its outer ends with a flat portion 2 which is bored completely through as indicated at 4. The file papers are provided with corresponding holes in alignment with the bores or openings in flat portions 2. Each of the securing members 3 consists of an elongated post 6, tapered at one and provided at the other end with an integral mushroom shaped head portion 5. Also forming part of the overall securing member is a fastener 7 shown exploded from the post in FIG. 1. The fastener which is apertured to fit over the tapered end of post 6, is internally toothed while the post is externally notched. The tooth and notch arrangement has a cam like configuration so that fastener 7 can be forced inwardly along post 6 and locked against outward movement along the post which as later described in greater detail, provides extremely effective clamping along the file edge.

In order to assemble the binding system, rigid support members 1 are positioned along the file edge with openings 4 aligned with the holes through the file papers. The posts of the securing members are fitted tapered end first, completely through the assembled arrangement including the two rigid support members and the file papers sandwiched between them. The mushroom shaped heads of the securing members prevent them from passing completely through the aligned openings. The fasteners 7 are then slid over the exposed tapered ends of the posts and forced along the posts until the two rigid support members are drawn tightly against the file edge with heads 5 and fasteners 7 firmly abutting the outer sides of the rigid support members. The fasteners are maintained in this position and prevented from sliding back along the posts by virtue of the tooth and notch arrangement as described above. It should be noted that the provision of the flattened areas at the outer ends of the rigid support members assures a flush fit for the securing portions of the fasteners at the outer sides of the support members.

As will now be appreciated from the above description the clamping action provided along the edge of the file is extremely effective and easily adjusted, according to the degree of tension required, by simply grasping the end of the post for leverage and sliding the fastener along the post to the desired position where it automatically locks in place. The support members are drawn in accordingly along the file edge so that they adjust to the file edge regardless of its thickness. The rigid support members can be made very low in profile so that they extend only very slightly to either side of the file edge for purposes of minimizing the filing space required for the file. Furthermore, they provide rigid support along the entire file edge so that no additional outer coverings or the like, are required to support the file edge.

If one wishes to add or remove papers from the file the distance or spacing between the support members is easily adjusted by simply cutting the fastener from the end of the securing post and repositioning the support members while either removing or adding the file papers. The adjusted file edge is quickly and easily reclamped using new fasteners but without replacing the support members, by virtue of the fact that the fasteners are totally independent of the support members other than in the securing position and as a result of the independent nature of the support members from one another, making them reusable with virtually any file size.

A preferred embodiment of the invention shown in FIGS. 1 through 4 includes rigid support members and fasteners identical to those described above with respect to FIGS. 7 and 8 with like parts being designated by like numerals. However, the structure of FIGS. 1 through 4, further includes the preferred feature of adjustable extension members 11 along the outer sides of the rigid support members. These extension members adapt the system for different types of filing systems, including both the shelf type system and the rack-hanging type system. Each of the adjustable extensions consists of a lower triangular body portion 15 and an upper body portion 13 extending outwardly beyond the end of portion 15. Portions 15 are slidably secured within a triangular open-topped channel 9 along the outer sides of each of the rigid support members. Each of the open-topped channels is formed by the base of the support members and its inwardly angled walls 10. The lower triangular body portions of the extension members are maintained within the triangular channels by virtue of the dove-tail mating fit between the two and due to the provision of stop portions 17 at the end of each of the channels. These stop portions are formed by scoring the channel walls and pressing the wall material downwardly against the base of the support.

Figure 3:
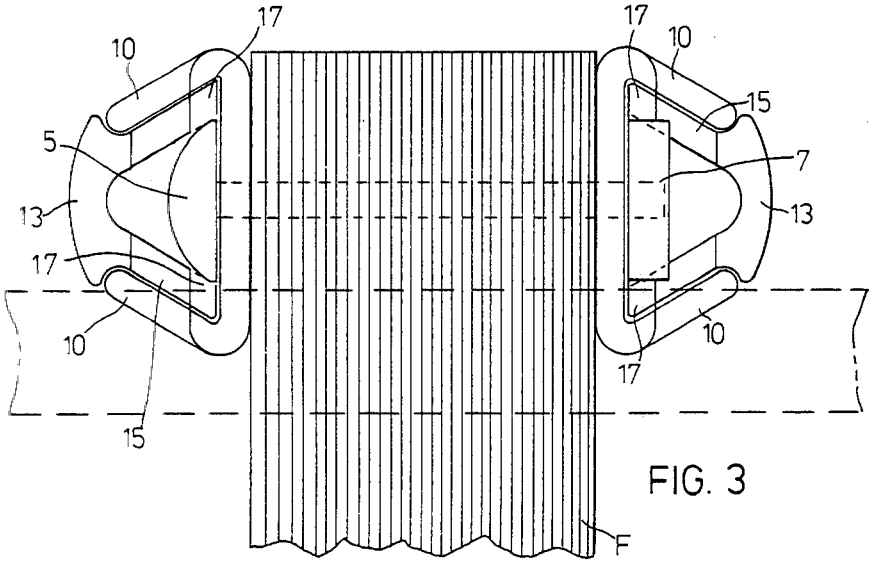
FIG. 3 is an enlarged end view of the arrangement shown in FIG. 2.

The extension members can take one of two positions, including the retracted position shown in FIG. 2 in which the file is adapted for filing in a standard bookshelf type filing system and the extended position shown in FIG. 4 adapting the file for use in a hanging filing system. It should be noted that in order to move the extension member to the outwardly extending position, it must first clear the securing portions of the fasteners. This is accomplished as a result of the construction of the extension members. As best shown in FIG. 3, the step like two tier structure of each extension member permits the upper outer tier to clear beyond each of the securing portions for extending the extension members beyond the end of the file. The extension members are quickly and easily returned to the retracted position by sliding them inwardly along their respective securing channels to gain access to the securing portions should file adjustment be required.

FIGS. 5 and 6 show a further embodiment of the invention in which there is a cooperation between the extension members and the securing portions of the securing members to bind the arrangement together. Here the file generally indicated at F, is also clamped along its edge by a pair of rigid support members 1 identical to those shown in FIGS. 1 through 4. However, the securing members are different from those above and comprise a pair of elongated tubular posts 23 having end portions 25. The length of each securing member is considerably greater than the thickness of the file so that when the securing member is inserted through the file, a significant length of each end portion 25 extends outwardly on either side of the file edge. This excess length of end portion is bent at approximately 90° to the main tubular post 23 to lie along the rigid support member and is fitted through the stops 17 beneath extension 11 which is hollowed as indicated at 14 to receive the end portion. As a result of the natural resiliency and memory of the securing member each end portion attempts to straighten itself with respect to the main tubular post thereby locking it in place beneath the extension.

In this particular arrangement, the extension members are adapted to not only ride over the securing end portions of the securing members but to also assist in the securing of the binding arrangement by locking the end portions in the securing position.

In order to disassemble the file binding arrangement of FIGS. 5 and 6 for purposes of either adding or deleting papers to and from the file, one needs only to slide the extension members inwardly along the support members until the securing end portions 25 are clear of the extension members. Due to the resiliency of the securing members, they automatically spring to the position shown in FIG. 5, for quickly and easily withdrawing them from the file. After the file has been adjusted accordingly, the securing members are simply fitted in place in the same manner as described above and locked in position by the extensions.

According to this embodiment, no trimming or cutting of the securing members is required regardless of the adjusted thickness of the file. The excess length in the ends of the securing members is simply slipped beneath the extension members so that if further adjustment is required to either increase or decrease the thickness of the file, the same securing members can be used without modifying the arrangement whatsoever.

Furthermore, as a result of the resiliency of each of the fasteners, there is no permanent deformation of the securing portions. As such the securing portions are bent flat along the support members to permit their securing beneath the extension members regardless of the fact that they may have been secured in a different position at some earlier date. This is in contrast to some prior art type arrangements in which metallic fasteners are bent and permanently deformed so that they cannot be adjusted after an initial setting to provide an equally effective binding of the file edge.

A further advantage resulting from the arrangement shown in FIGS. 5 and 6 is that papers can be added or removed to and from each side of the file without disturbing the other side of the file. As can be seen in the drawings the securing portions on one side of the binding arrangement can be released while maintaining their securing positions. Therefore, a person adjusting the file does not have to release the entire arrangement and remove all of the file papers to make an adjustment to one side of the file only, regardless of which side is adjusted.

As was the case with the earlier described arrangement this particular embodiment is adapted to both the bookshelf type filing systems and hanger type systems. The extensions can be retracted far enough inwardly to provide bookshelf filing yet still provide locking engagement with the extension members due to excessive length of the securing portions of each securing member. On the otherhand, for hanger type systems, the hollowing 14 in the underside of members 11 which continues throughout both the upper and lower tiers of the extensions permits their maximum outward extension while overriding the secured ends 25 of posts 23.

From the above, it will now be appreciated that the file binding system of the present invention is quickly and easily adjustable to various size file capacities and at the same time, adaptable to different types of filing systems. Furthermore, the specific arrangement of providing securing members with outwardly exposed securing ends makes it possible to clamp the entire arrangement tightly along the file edge. This not only makes the file neat and easy to work with but also ensures that the binding arrangement has only a slightly greater thickness than the file itself so that the file does not occupy excessive filing space. To this end, the extension members have been constructed with a very low profile, however, because there are two extension members at each end of the file there is more than adequate support for the file.

Although various preferred embodiments of the invention have been described herein in detail, it will be apparent to one skilled in the art, that variations may be made thereto, without departing from the spirit of the invention or the scope of the appended claims.

The embodiments of the invention in which an exclusive property or privilege is claimed are defined as follows:

1. A file binding system comprising a pair of elongated rigid support members for supporting a file along its edge, securing members for securing the support members in a binding position, each of the securing members being provided with securing portions adapted for fitting through and securing the support members from their outer sides to provide an effective clamp of the file between the support members, and adjustable extension members along the outer sides of said rigid support members, said rigid support members being separable from one another when removed from the binding position and said securing members being independent of said rigid support members other than in the binding position to facilitate binding adjustment, each of said extension members being two-tiered in construction and comprising a lower hollow tier and an upper tier section raised and extended relative to the lower tier, the lower tiers of said extension members being slidable within the support members which are shaped to cooperate with the lower tiers and which are undercut to secure the lower tiers therein, the upper tiers of said extension members being adapted to override the securing portions of the securing members, each of which is made of resilient material with said securing portions being folded beneath the hollowed triangular tiers of extension members, the resiliency of each securing member driving said securing portions to a locking engagement with said extension members, said extension members being retractable inwardly of the securing portions of the securing members to gain access to said securing portions.

2. A file binding system comprising a pair of elongated rigid support members for supporting a file along its edge, securing members for securing the support members in a binding position, each of the securing members being provided with securing portions adapted for fitting through and securing the support members from their outer sides to provide an effective clamp of the file between the support members, and adjustable extension members along the outer sides of said rigid support members; said rigid support members being separable from one another when removed from the binding position and said securing members being independent of said rigid support members other than in the binding position to facilitate binding adjustment, said extension members having a two-tiered structure comprising a lower shouldered tier section and an upper low profile tier section with said support members provided with undercut open topped channels, to slidably receive the lower shouldered tier section of said extension members, said support members being provided with stop means at their ends for preventing withdrawal of the lower shouldered tier sections of the extension members therefrom, the arrangement being such that said upper tier sections of said extension members are raised relative to the lower tier sections and are located outwardly of the support members for overriding the securing portions of the securing members and said extension members being retractable inwardly of the securing portions to gain access thereto.

3. A file binding system as claimed in claims 1 or 2 wherein said upper tier sections of said extension members are low profile.

4. A file binding system as defined in claim 3, wherein said extension members are adapted to override and lock said securing portions in the securing position.

5. A file binding arrangement as claimed in claim 4 wherein said securing members are made of resilient material with said securing portions being folded beneath the extension members which are recessed to receive the securing portions, the resiliency of the securing member material driving said securing portions to a locking engagement with said extension members.

* * * * *